United States Patent [19]

Minzey

[11] 3,955,223

[45] May 11, 1976

[54] FURNITURE HAVING A BOX SPRING OR LIKE STRUCTURE AND SUPPORTING LEG MEMBERS THEREFOR

[75] Inventor: Ronald D. Minzey, Elkhart, Ind.

[73] Assignee: Congoleum Industries, Inc., Kearny, N.J.

[22] Filed: May 8, 1975

[21] Appl. No.: 575,890

[52] U.S. Cl. ..... 5/310; 297/445

[51] Int. Cl.[2] ..... A47C 19/00

[58] Field of Search ..... 297/445, 422; 5/310, 5/316; 108/51; 248/188.8

[56] References Cited

UNITED STATES PATENTS

| | | | |
|---|---|---|---|
| 1,982,165 | 11/1934 | Hounsfield | 5/310 X |
| 2,084,595 | 6/1937 | Preston | 248/188.8 X |
| 2,466,226 | 4/1949 | Gilbertie | 5/310 X |
| 2,841,209 | 7/1958 | Wetzler | 5/310 X |

*Primary Examiner*—Paul R. Gilliam
*Assistant Examiner*—Andrew M. Calvert
*Attorney, Agent, or Firm*—Richard T. Laughlin

[57] ABSTRACT

In a piece of furniture, a box spring or like structure comprising a substantially rectangular frame including longitudinally-extending side frame members and transversely-extending end frame members, and a plurality of supporting leg members secured to the box spring or like structure and supporting it substantially horizontally at a predetermined distance from a floor or other supporting surface, each of the supporting leg members comprising an elongated structural member formed into a generally W-shaped configuration wherein (1) the central portion is secured to a longitudinally-extending side frame member, (2) V-shaped portions adjacent each side of the central portion extend inwardly of the longitudinally-extending side frame members and downwardly to support the box spring or like structure substantially horizontally at a predetermined distance from a floor or other supporting surface, and finally (3) end portions extend still farther inwardly of the longitudinally-extending side frame members to be secured to the box spring or like structure inwardly of the longitudinally extending side frame members.

10 Claims, 3 Drawing Figures

FURNITURE HAVING A BOX SPRING OR LIKE STRUCTURE AND SUPPORTING LEG MEMBERS THEREFOR

GENERAL BACKGROUND OF THE INVENTION

The present invention relates to furniture such as, for example, couches, sofas, daybeds, divans, davenports, beds, or other pieces of furniture having box spring or similar structures and mattresses, cushions or pads upon which people are accustomed to sit or recline at full length. More specifically, the present invention relates to such pieces of furniture and to the box spring or similar structure therein and the supporting leg members therefor.

In the production of supporting leg members for box spring or similar structures, it has always been desired that such supporting leg members be economically priced, light weight but sturdy, easily attached to substantially all conventionally made box spring or other frame structures and easily removed therefrom, if desired for reuse or replacement. It has also been desired that such supporting leg members be secured in a recessed, non-toe-stubbing location, that their lower surfaces or bottoms be designed so as to permit mobility to provide ease of sliding on floors or other supporting surfaces for cleaning underneath or for other purposes, and that there be a minimum of parts to work loose and be lost.

Some of these desirable features and advantages are found in some presently commercially available supporting leg members for box spring or like structures. However, all of these desirable features and advantages are not presently found in any one specific supporting leg member for any box spring or similar structure.

GENERAL PURPOSES AND OBJECTS OF THE INVENTION

It is therefore a principal purpose and object of the present invention to provide a supporting leg member for box spring or similar structures having all the previously described features and advantages.

BRIEF SUMMARY OF THE INVENTION

It has been discovered that these purposes and objects, as well as other purposes and objects which will become apparent from a further reading of this specification, can be obtained by providing in a piece of furniture, a box spring or like structure comprising a substantially rectanguar frame including longitudinally-extending side frame members and transversely-extending end frame members, and a plurality of supporting leg members secured to the box spring or like structure and supporting it substantially horizontally at a predetermined distance above a floor or other supporting surface, each of the supporting leg members comprising an elongated structural member formed into a generally W-shaped configuration wherein (1) the central portion is secured to a longitudinally-extending side frame member, (2) V-shaped portions adjacent to each side of the central portion extend angularly inwardly of the longitudinally-extending side frame members and downwardly to support the box spring or similar structure substantially horizontally at a predetermined distance from a floor or other supporting surface, and (3) end portions extend still farther inwardly of the longitudinally-extending side frame members to be secured to the box spring or like structure inwardly of the longitudinally-extending side frame members.

The invention will be more particularly described and illustrated with specific reference to a supporting leg member secured to a box spring structure which is a kind of bedspring comprising normally spiral or similar springs attached to a foundation, enclosed within a box-like frame, and covered with a fabric, or a light mattress, or other like material. However, such is to be considered as merely illustrative of the present invention and not limitative of the broader aspects thereof.

The invention will be better understood from the following detailed specification and accompanying self-explanatory drawings wherein there are described and illustrated preferred embodiments of the invention. The invention, however, is not to be construed as limited to such preferred embodiments which are illustrative and not limitative of the broader aspect of the present invention.

BRIEF DESCRIPTION OF THE DRAWINGS

Referring to the accompanying drawings which, incidentally, are not precisely drawn to scale and wherein certain of the elements are increased or decreased in size for the purposes of a clearer, more understandable disclosure of the invention.

DETAILED DESCRIPTION OF THE INVENTION

THE BOX SPRING STRUCTURE

Figure 1:
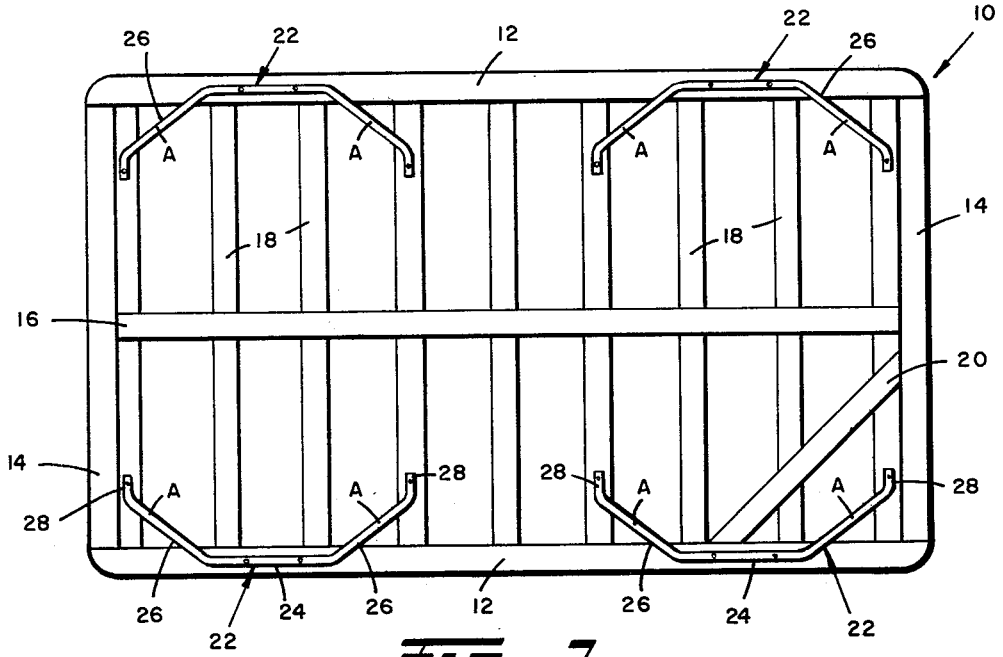
FIG. 1 is a schematic, fragmentary, bottom plan view of the underneath construction of a box spring structure and supporting leg members secured thereto, emboding the principles of the present inventive concept.
Figure 2:
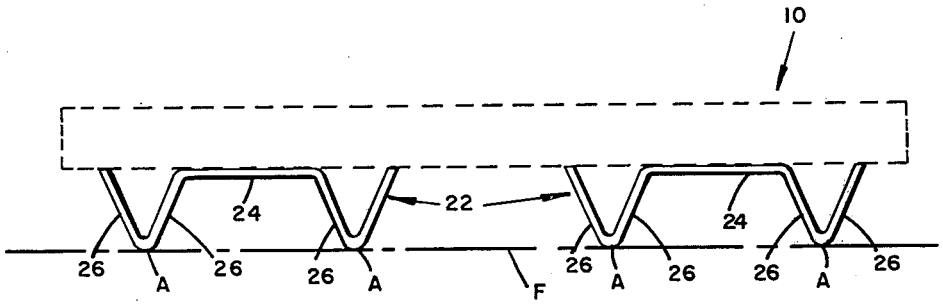
FIG. 2 is a schematic, fragmentary, side elevational view of the box spring structure (now shown in dotted phantom outline) and supporting leg members of FIG. 1.

In the preferred embodiment of the invention, as shown in FIGS. 1 and 2 of the drawings, there is shown a box spring structure 10 comprising a pair of substantially parallel, longitudinally-extending side frame mambers 12, 12 and a pair of substantially parallel, transversely-extending end frame members 14, 14, which are secured together at their corners to form a substantially rectangular framework for a box spring structure.

These structural members 12, 12 and 14, 14, as well as the other structural members to be described hereinafter, are preferably wooden but it is to be readily appreciated that other structural materials, notably metals such as steel, iron, aluminum, or magnesium, or alloys thereof, may also be used.

Intermediate the longitudinally-extending side frame members 12, 12 and generally parallel thereto, there is positioned one or more intermediate longitudinally-extending frame strengthening and reinforcing members 16. And, intermediate the transversely-extending end frame members 14, 14, and generally parallel thereto, there are positioned a plurality of intermediate transversely-extending strengthening and reinforcing members 18.

In FIGS. 1 and 2, nine intermediate transversely-extending frame strengthening and reinforcing members 18 are shown but it is to be appreciated that a lesser or a greater number of these flat reinforcing members 18 may be used, as is desired or required. Normally, these reinforcing members 18 are evenly or equidistantly spaced but such is not essential. Also, the widths of the individual reinforcing members 18 may be varied to suit the needs and the requirements of the particular situation.

Angularly extending corner strengthening and reinforcing braces 20 may also be employed to further increase the strength, rigidity and the sturdiness of the box spring structure 10. Only one of these corner braces 20 is shown in FIG. 1 but there will normally be at least one corner brace at each corner of the box spring structure 10.

The remaining parts of the box spring structure 10 are conventional and are well known in the industry and include such elements as spiral, helical or other types of springs; spring retaining and holding clips, strips and tabs; insulating or other cushioning materials; fabric or other sheet material coverings; etc. These elements have not been shown in the drawings inasmuch as they are standard and conventional; they do not relate to the essence of the inventive concept; and their inclusion in the drawings and in the specification could tend only to obfuscate a clearer understanding of the inventive concept.

THE SUPPORTING LEG MEMBERS

As shown in FIGS. 1 and 2, the box spring structure 10 is supported substantially horizontally at a predetermined distance above a floor F or other supporting surface by a plurality of generally W-shaped supporting leg members 22 which are secured to the longitudinally-extending side frame members 12, 12 and to the transversely-extending strengthening and reinforcing members 18 or, if desired or advantageous, to the transversely-extending end frame members 14, 14.

The W-shaped configuration of the supporting leg members 22 relates to the essence of the present invention and warrants special consideration. The supporting leg member 22 is normally made of a metal such as steel, iron, aluminum or magnesium, or alloys thereof and is preferably made in tubular form having an outside diameter of from about ¾ inch to about 1 inch and a wall thickness of from about 0.030 inch to about 0.050 inch (from about 18 gauge to about 20 gauge.). The supporting leg member 22 comprises a relatively straight central portion 24 which is secured, such as by a pair of screws or other fastening devices, passing through openings in the supporting leg member 22, to the bottom of the longitudinally-extending side frame member 12, as shown in FIG. 1 of the drawings.

Immediately adjacent to each side of the straight central portion 24 is a generally V-shaped portion 26, 26 which at first angularly extends downwardly and contacts the floor F or other supporting surface and then returns angularly upwardly, as best shown in FIG. 2. In the formation of the generally V-shaped portions 26, 26, care is taken that the lowermost parts or toes thereof which contact the floor F or other supporting surface are smooth and arcuate or curved and do not possess any angular or sharp corners or rough edges. Such a substantially smooth and arcuate or curved lowermost part is therefore capable of sliding relatively smoothly and easily on the floor F or other supporting surface. This, of course, is of value to a housewife who is thus able to easily slide the bed or like structure out, as she wishes so that she can clean underneath, or make up the bed, and so forth.

In the formation of the generally V-shaped portions 26, 26 it is to be appreciated that the V which is formed is preferably equilateral, that is, both legs of the V-shape are approximately equal and thus form the vertex of an inverted isosceles triangle, in which the two base angles are approximately equal. This, of course, is not only for esthetic or appearance purposes but also functional utilitarian strength and stability purposes.

Additionally, it is to be noted that the V-shaped portions in addition to extending downwardly to contact the floor F and then returning upwardly to meet the box spring structure 10 to form the desired V-shape, are bent angularly rearwardly so that, as best shown in FIG. 1, they extend inwardly of the longitudinally-extending side frame members 12, 12. With such an inwardly bent configuration, the lowermost parts of the V-shaped portions 26, 26 contact the floor F or other supporting surface at a plurality of points A which are well within and underneath the overhang formed by the outer edges of the box spring structure 10. In this way, it is almost impossible, or at least highly improbable for anyone working on or walking near or around the bed to stub their toes on the supporting leg member.

The angle through which the V-shaped portions 26, 26 are bent rearwardly and inwardly, as best shown in FIG. 1, is about 30° but could be as much as 45° as well and, as a matter of fact, could be as little as about 15°, at which degree the sides of the V-shaped portions begin to approach the longitudinally-extending side frame members 12, 12 and to begin to raise the possibility of toe-stubbing again. The angle may be increased to as much as 60°, at which degree the ends of the W-shaped supporting leg member 22 begin to undersirably approach each other too closely underneath the box spring structure 10.

The precise angle which is used in any particular case is, of course, largely affected and determined by the width, spacing and general arrangement and relationship of the longitudinally-extending side frame members 12, 12 and the intermediate transversely-extending strengthening and reinforcing members 18 and the transversely-extending end frame members 14, 14. For reasons which will become clearer by being described in greater detail hereinafter, the bending of the V-shaped portions must be such that their outer extremities, as a minimum, at least reach to one of the previously mentioned transversely-extending members.

As noted, the central portion 24 and the two immediately adjacent V-shaped portions 26, 26 primarily constitute the main body of the W-shaped supporting leg member 22. However, there is another feature and advantage to the supporting leg member 22. At the ends of the upward part of the outer extremities of the V-shaped portions 26, 26 at a point well within the outer edge of the box spring structure 10, there are relatively short end portions 28, 28 which are best seen in FIG. 1 but not seen in FIG. 2 inasmuch as such relatively short end portions 28, 28 fall behind and are hidden by the upper ends of the outer extremities of the V-shaped portions 26, 26. As shown in FIG. 1, the short ends 28, 28 lie against and contact the transversely-extending members 18.

The short end portions 28, 28 may be bent even farther to approximately an angle of about 90° to the vertical plane containing the central portion 24 and the longitudinally-extending side frame member 12. In such a configuration, the short ends 28, 28 may extend basically in the same direction as the transversely-extending frame strengthening and reinforcing members 18 or the transversely-extending end frame members 14, 14. It is therefore simple to secure the short ends of each supporting leg member 22 to the bottom surface of a transversely-extending member by means of a screw or other fastening device. If desired, openings may be pre-punched at a few places along the short ends 28, 28 in order to facilitate the securing of the supporting leg member in place. In this way, the box spring structure is maintained at the predetermined distance above the floor F or other supporting surface.

Such a fastening arrangement for the supporting leg members 22 wherein (1) two screws firmly secure the central portion 24 thereof to the longitudinally-extending side frame members 12, 12 and (2) two screws firmly secure the end portions 28, 28 thereof to the transversely extending strengthening and reinforcing members 18 or the transversely-extending end frame members 14, 14 well inwardly of the longitudinally-extending side frame members 12, 12 materially and substantially adds to the sturdiness and the rigidity of the box spring structure 10 and to the stability and the steadfastness of the supporting leg members 22, 22 which show little or no tendency to work loose during use.

THE SUPPORTING LEG MEMBER MODIFICATION OF FIG. 3

Figure 3:
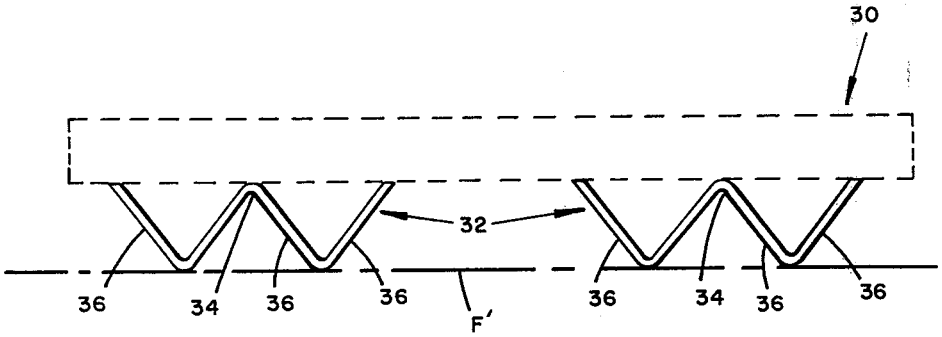
FIG. 3 is a schematic, fragmentary, side elevational view of a modification of the supporting leg members shown in FIGS. 1 and 2, with the box spring structure again shown in dotted phantom outline.

A modification of the W-shaped supporting leg member is shown in FIG. 3. In this modification, a box spring structure 30 is supported by a plurality of W-shaped supporting leg members 32 which have a central portion 34 which is of very short length and actually may be no more than a curve or an arcuate portion of the W-shaped supporting leg member 32. Merely one screw or other fastening device is required to secure the central portion 34 to the longitudinally-extending side frame member (not shown in FIG. 3) and two screws or other fastening devices are required, as was previously required in the embodiment of FIGS. 1 and 2, to secure the transversely-extending short end portions of the supporting leg member 32 to the transversely-extending strengthening and reinforcing members or the end frame members (also not shown in FIG. 3).

Again, the features and advantages of increased sturdiness and rigidity of the box spring structure and increased stability and steadfastness of the supporting leg members 32 are noted. The other portions of the supporting leg member 32, such as the V-shaped portions 36 and the relatively short end portions (not shown), as well as other elements of the box spring structure, are as previously described herein, unless specifically indicated otherwise. In this manner, the box spring structure 30 is maintained substantially horizontally at a predetermined distance above the floor F′ or other supporting surface.

The invention will be further illustrated and described in greater detail in the following specific examples. It should be understood, however, that, although these examples may describe in particular detail some of the more specific details and features of the present invention, they are given primarily for purposes of illustration only and the inventive concept in its broader aspects is not to be costrued as limited thereto.

EXAMPLE I

A box spring structure having four W-shaped supporting leg members, as shown in FIGS. 1 and 2, is constructed. The W-shaped configuraion of the supporting leg member is formed from ⅞ inch O.D., 19 gauge (0.042 inch), cold roll steel tubing having an original length of 47 inches. Four holes are pre-punched in each 47 inch length of the tubular structure to permit the securing, as by screws, of the generally W-shaped supporting leg members to the longitudinally-extending side frame members and to the transversely-extending strengthening and reinforcing members on the bottom of the box spring structure to hold it substantially horizontally at a predetermined distance above the floor.

More specifically, the central portion of the generally W-shaped tubular supporting leg member is substantially straight and is secured by two screws to the longitudinally-extending side frame member. The two V-shaped portions which are immediately adjacent to each side of the stright central portion extend angularly and inwardly of the longitudinally-extending side frame member and lie basically in vertical planes which extend at angles of 30° to the vertical plane containing the central portion and the longitudially-extending side frame mamber. As noted in FIG. 2, the first leg of the V-shaped portion extends angularly downwardly and contacts the floor, where as the second leg of the V-shaped portion then extends upwardly angularly and contacts the transversely-extending frame strengthening and reinforcing member.

The relatively short end portion which remains of the original 47 inch length is then bent downwardly and rearwardly or further inwardly so as to lie in a horizontal plane in contact for its full length with the transversely-extending frame strengthening and reinforcing member, as shown in FIG. 1. Each relatively short end is secured by a screw to the transversely-extending frame strengthening and reinforcing member.

The construction is simple and the resulting box spring structure is sturdy and durable and possesses strength and rigidity and the features and advantages previously described herein.

EXAMPLE II

The procedures of Example I are followed substantially as described therein with the exception that the 47 inch piece of cold roll steel tubing is formed into a supporting leg member having the W-shaped configuration of FIG. 3. The forming and the bending of 47 inch piece of tubing is as described in Example I, except that the relatively short end portions are slightly longer than the relatively short end portions of Example I. Only three holes are required to be pre-punched in the supporting leg member for attachment by screws to the longitudinally-extending side frame members and the transversely-extending frame strengthening and reinforcing members at the bottom of the box spring structure. The previously described features and advantages are also present in this structure.

EXAMPLE III

The procedures of Example I are followed substantially as set forth therein with the exception that the cold roll steel tubing is replaced by aluminum tubing. The wall thickness, however, is increased to 0.050 inch. The construction is simple and the resulting box spring structure is sturdy and durable and possesses the required strength and rigidity and the desired features and the advantages previously described herein.

Although specific examples of the inventive concept have been described, the same should not be construed as limited thereby nor to the specific features mentioned therein but to include various other equivalent features as set forth in the claims appended hereto. It is understood that any suitable changes, modifications and variations may be made without departing from the spirit and the scope of the inventive concept.

What is claimed is:

1. In a piece of furniture, a box spring or like structure comprising a substantially rectangular frame including longitudinally-extending side frame members and transversely-extending end frame members, and a plurality of supporting leg members secured to said box spring or like structure and supporting the same substantially horizontally at a predetermined distance above a floor or other supporting surface, each of said supporting leg members comprising an elongated structural member formed into a generally W-shaped configuraton wherein (1) a central portion is secured to said longitudinally-extending side frame member, (2) V-shaped portions adjacent to each side of said central portion extend angularly inwardly of the longitudinally-extending side frame members and downwardly to support said box spring or like structure substantially horizontally at a predetermined distance above a floor or other supporting surface, and (3) end portions extend inwardly of said longitudinally-extending side frame members to be secured to said box spring or like structure inwardly of said longitudinally-extending side frame members.

2. A piece of furniture as defined in claim 1 wherein there is at least one longitudinally-extending frame strengthening and reinforcing member located intermediate said longitudinally-extending side frame members.

3. A piece of furniture as defined in claim 1 wherein there is a plurality of transversely-extending frame strengthening and reinforcing members located intermediate said transversely-extending end frame members.

4. A piece of furniture as defined in claim 1 wherein there are four supporting leg members.

5. A piece of furniture as defined in claim 1 wherein said supporting leg members are tubular.

6. A piece of furniture as defined in claim 1 wherein said supporting leg members are made of tubular steel.

7. A piece of furniture as defined in claim 1 wherein said V-shaped portions of said supporting leg member extend angularly inwardly of said longitudinally-extending side frame members.

8. A piece of furniture as defined in claim 7 wherein said V-shaped portions of said supporting leg member extend at an angle of from about 15° to about 60° to said longitudinally-extending side frame members.

9. A piece of furniture as defined in claim 1 wherein said end portions of said supporting leg members lie in a plane approximately at right angles to the plane containing said central portion and said longitudinally-extending side frame member.

10. A piece of furniture as defined in claim 3 wherein said end portions of said supporting leg members are secured to said transversely-extending frame strengthening and reinforcing members inwardly of said longitudinally-extending side frame members.

* * * * *